US007958948B2

(12) United States Patent
Stave

(10) Patent No.: US 7,958,948 B2
(45) Date of Patent: Jun. 14, 2011

(54) METHOD AND SYSTEM FOR RETURN OF DRILLING FLUID

(75) Inventor: Roger Stave, Knarvik (NO)

(73) Assignee: AGR Subsea AS, Straume (NO)

( * ) Notice: Subject to any disclaimer, the term of this patent is extended or adjusted under 35 U.S.C. 154(b) by 747 days.

(21) Appl. No.: 11/660,568

(22) PCT Filed: Aug. 18, 2005

(86) PCT No.: PCT/NO2005/000296

§ 371 (c)(1),
(2), (4) Date: Oct. 9, 2007

(87) PCT Pub. No.: WO2006/031119

PCT Pub. Date: Mar. 23, 2006

(65) Prior Publication Data

US 2008/0190663 A1 Aug. 14, 2008

(30) Foreign Application Priority Data

Aug. 19, 2004 (NO) ..... 20043467

(51) Int. Cl.
*E21B 7/128* (2006.01)

(52) U.S. Cl. ..... 175/7; 175/25; 175/38; 175/48; 175/207; 175/209; 175/217; 166/344; 166/347; 166/351; 166/352; 166/358

(58) Field of Classification Search ..... 175/7, 5, 175/25, 38, 48, 207, 209, 217; 166/338, 166/339, 344, 347, 351, 352, 358, 368, 250.01
See application file for complete search history.

(56) References Cited

U.S. PATENT DOCUMENTS 4,063,602 A * 12/1977 Howell et al. ..... 175/7
4,149,603 A * 4/1979 Arnold ..... 175/7

(Continued)

FOREIGN PATENT DOCUMENTS

EP 0290250 11/1988

(Continued)

OTHER PUBLICATIONS

International Search Report mailed on Dec. 19, 2005 by the Swedish Patent Office in Counterpart foreign application No. PCT/NO2005/000296.

(Continued)

*Primary Examiner* — Thomas A Beach
*Assistant Examiner* — Matthew R Buck
(74) *Attorney, Agent, or Firm* — Abelman, Frayne & Schwab

(57) ABSTRACT

A system and method is described for use and return of drilling fluid/cuttings from a well, which is drilled on the ocean floor, in connection with offshore related oil production and gas production, where, from a drilling rig or drilling vessel (10), a drill stem (12) runs down into the bore hole and where a blowout preventer (BOP) is placed on said well, without mounting a riser between the rig or the vessel and said blowout preventer. A sealing and pressure-regulating device (16) is arranged on the blowout preventer (14) arranged to regulate the level of the drilling fluid, and thus the outlet pressure of the drilling fluid in said sealing and pressure-regulating device, and a pump module (18) is set up at a suitable distance adjacent said sealing and pressure-regulating device, where the pump module is arranged to pump said drilling fluid up to the ocean surface via an external return pipe.

28 Claims, 8 Drawing Sheets

U.S. PATENT DOCUMENTS

| | | | | |
|---|---|---|---|---|
| 5,469,917 | A * | 11/1995 | Wolcott | 166/250.01 |
| 6,062,313 | A * | 5/2000 | Moore | 166/357 |
| 6,142,236 | A * | 11/2000 | Brammer et al. | 166/358 |
| 6,352,114 | B1 * | 3/2002 | Toalson et al. | 166/343 |
| 6,415,877 | B1 * | 7/2002 | Fincher et al. | 175/5 |
| 6,457,529 | B2 * | 10/2002 | Calder et al. | 166/368 |
| 6,484,816 | B1 * | 11/2002 | Koederitz | 175/25 |
| 6,648,081 | B2 * | 11/2003 | Fincher et al. | 175/25 |
| 6,745,851 | B1 * | 6/2004 | Edvardsen | 175/5 |
| 6,755,261 | B2 * | 6/2004 | Koederitz | 175/25 |
| 6,854,532 | B2 * | 2/2005 | Fincher et al. | 175/5 |
| 6,877,565 | B2 * | 4/2005 | Edvardsen | 166/352 |
| 6,966,367 | B2 * | 11/2005 | Butler et al. | 166/105 |
| 7,011,152 | B2 * | 3/2006 | Soelvik | 166/65.1 |
| 7,066,247 | B2 * | 6/2006 | Butler et al. | 166/105 |
| 7,185,705 | B2 * | 3/2007 | Fontana | 166/356 |
| 2004/0124008 | A1 | 7/2004 | Fincher et al. | |

FOREIGN PATENT DOCUMENTS

| | | |
|---|---|---|
| NO | 308.043 | 7/2000 |
| NO | 312.915 | 7/2002 |
| NO | 2003 5172 | 11/2003 |
| NO | 318.767 | 5/2005 |
| WO | WO 99 61745 | 12/1999 |
| WO | WO 2005/049958 A1 | 6/2005 |

OTHER PUBLICATIONS

Written Opinion of the International Searching Authority mailed Dec. 19, 2005 by the Swedish Patent Office in counterpart foreign application No. PCT/NO2005/000296.

* cited by examiner

Sea bed

METHOD AND SYSTEM FOR RETURN OF DRILLING FLUID

The present invention relates to a method and system for use of and return of drilling fluid/cuttings from a well which is drilled on the ocean floor in connection with offshore related oil production and gas production, as described in the preamble of the independent claims 1 and 13. In particular, the invention shall be used without a riser being mounted between the drilling rig or the drilling vessel and blowout preventer.

Today's requirements relating to environmental discharges place rigid demands on the operators in the oil industry. For example, it is a requirement that there is to be no discharge of drilling fluid during drilling. During drilling of a new oil well in the ocean bed, or drilling in an already existing well, large amounts of drilling fluid which must be treated are produced. This can be oil-based drilling fluid or water-based drilling fluid, depending on whether the drilling that is carried out is top-hole drilling or drilling in the oil zones.

From known technology, U.S. Pat. No. 4,149,603 is referred to. This system discloses a solution where use of a riser is eliminated in drilling operations under water. The system comprises a pump that can be coupled to the upper part of an underwater drilling head and has a lower part with an inlet and an upwardly extending wall which collaborates with the lower part, and also means to prevent the water from coming in contact with only the upper part of the cuttings, as cuttings pass upwards from the lower inlet. The cuttings are further transported to the surface with the help of a pump via a hose.

A disadvantage with the mentioned U.S. Pat. No. 4,149,603 is, among other things, that the outlet pressure of the drilling fluid can not be regulated independently of the surrounding water pressure.

The object of the present invention is to provide a solution for return of drilling fluid/cuttings without a riser being arranged between the drilling rig or the drilling vessel and the well.

This object is achieved with a method as defined in the independent claim 1.

Alternative preferred embodiments of the method are characterized by the dependent claims 2-12.

The invention also relates to a system as defined in the independent claim 13, while an alternative embodiment of the system is defined in claim 14.

The invention shall now be described in more detail with reference to the enclosed figures, in which.

Figure 1:
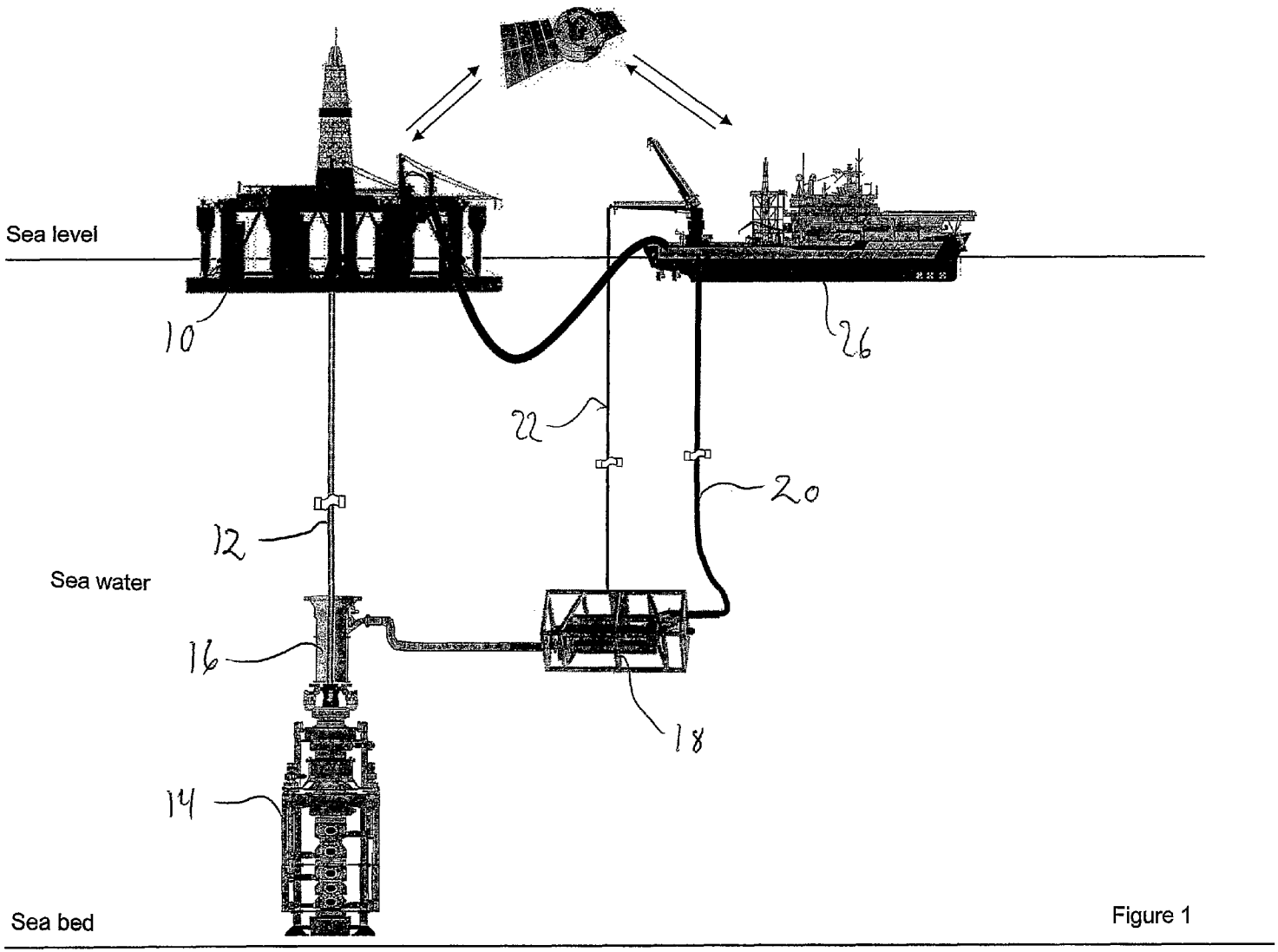
FIGS. 1-6 show different embodiments of a system according to the invention.
Figure 2:
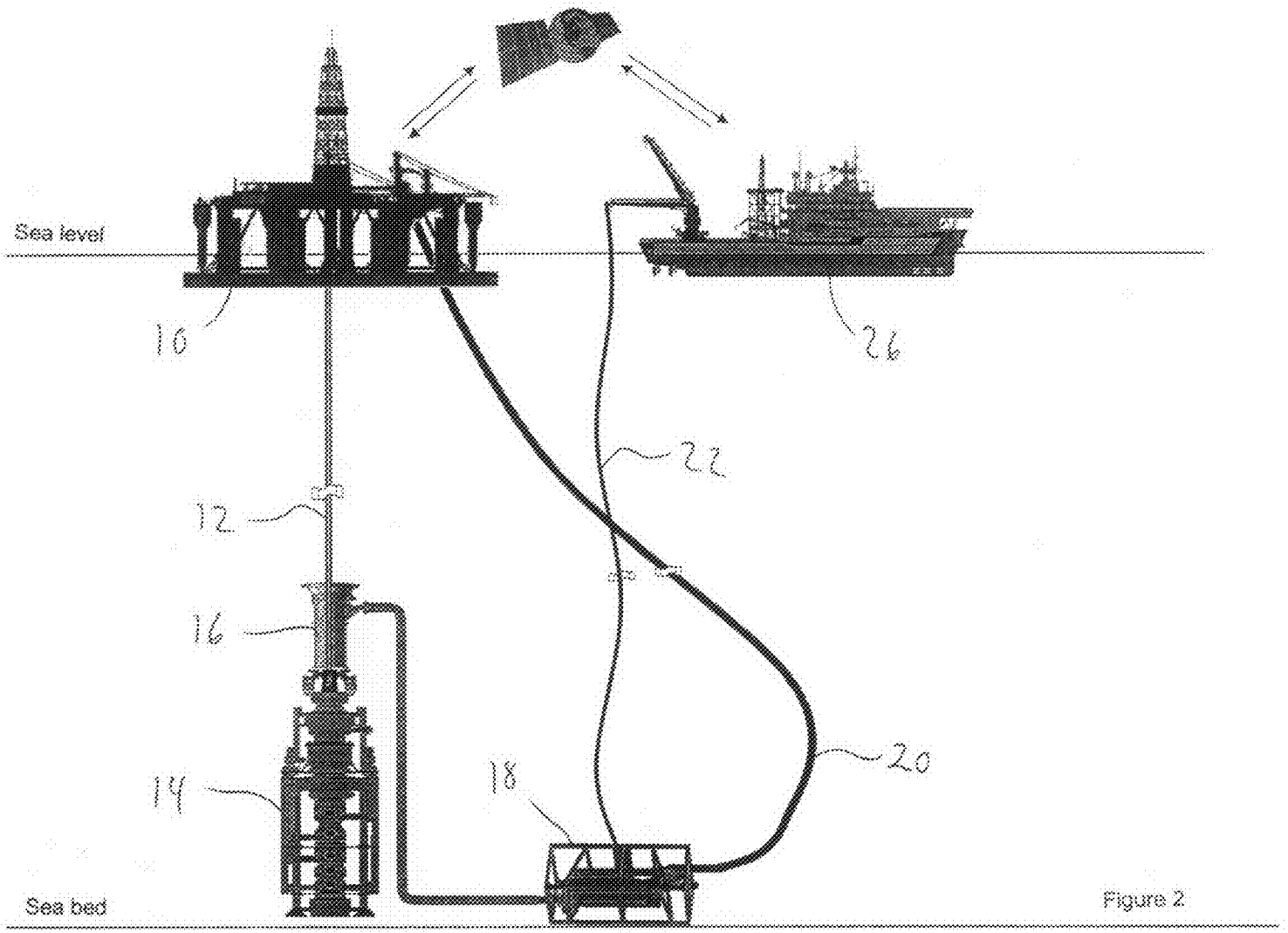
Figure 3:
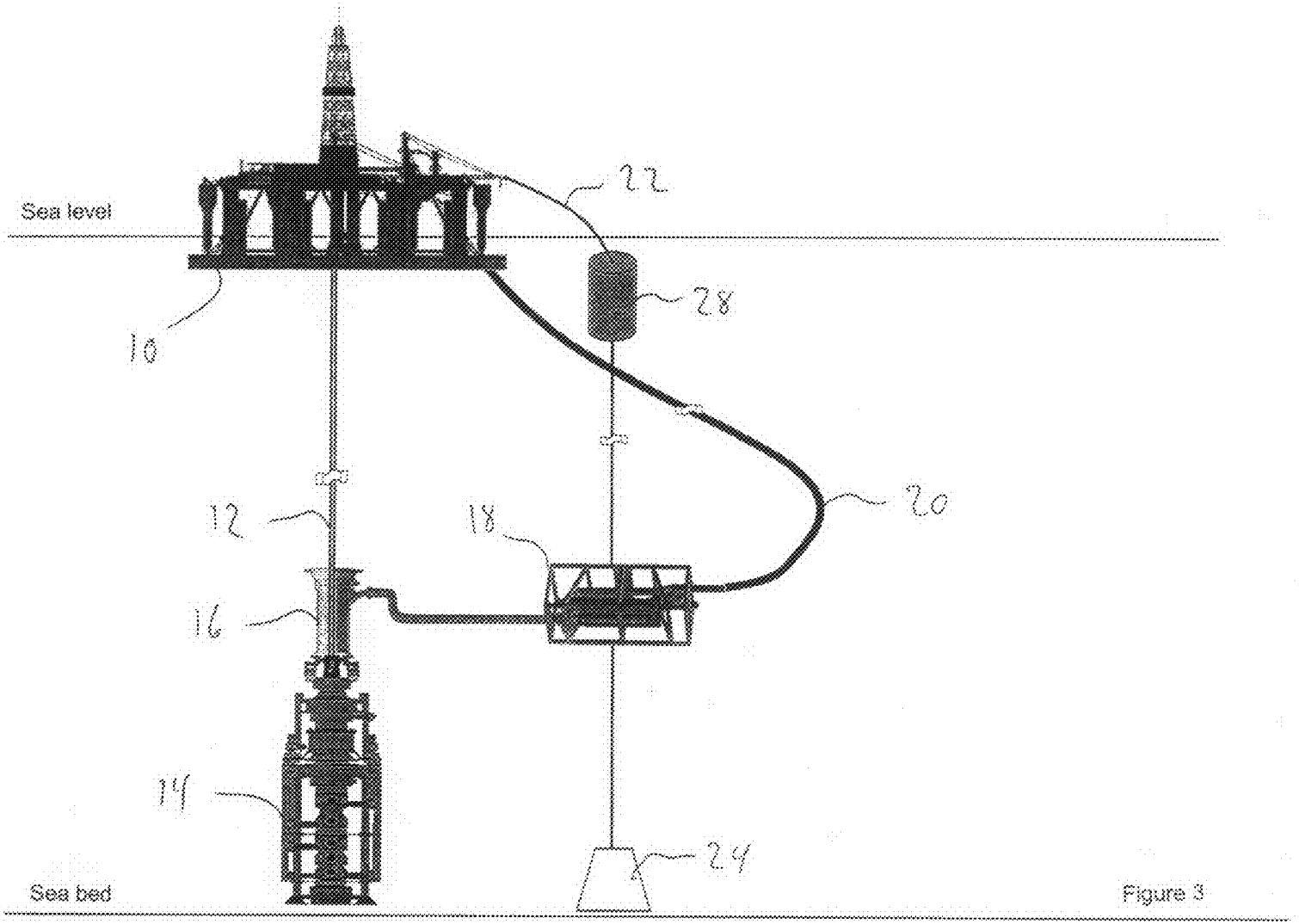
Figure 4:
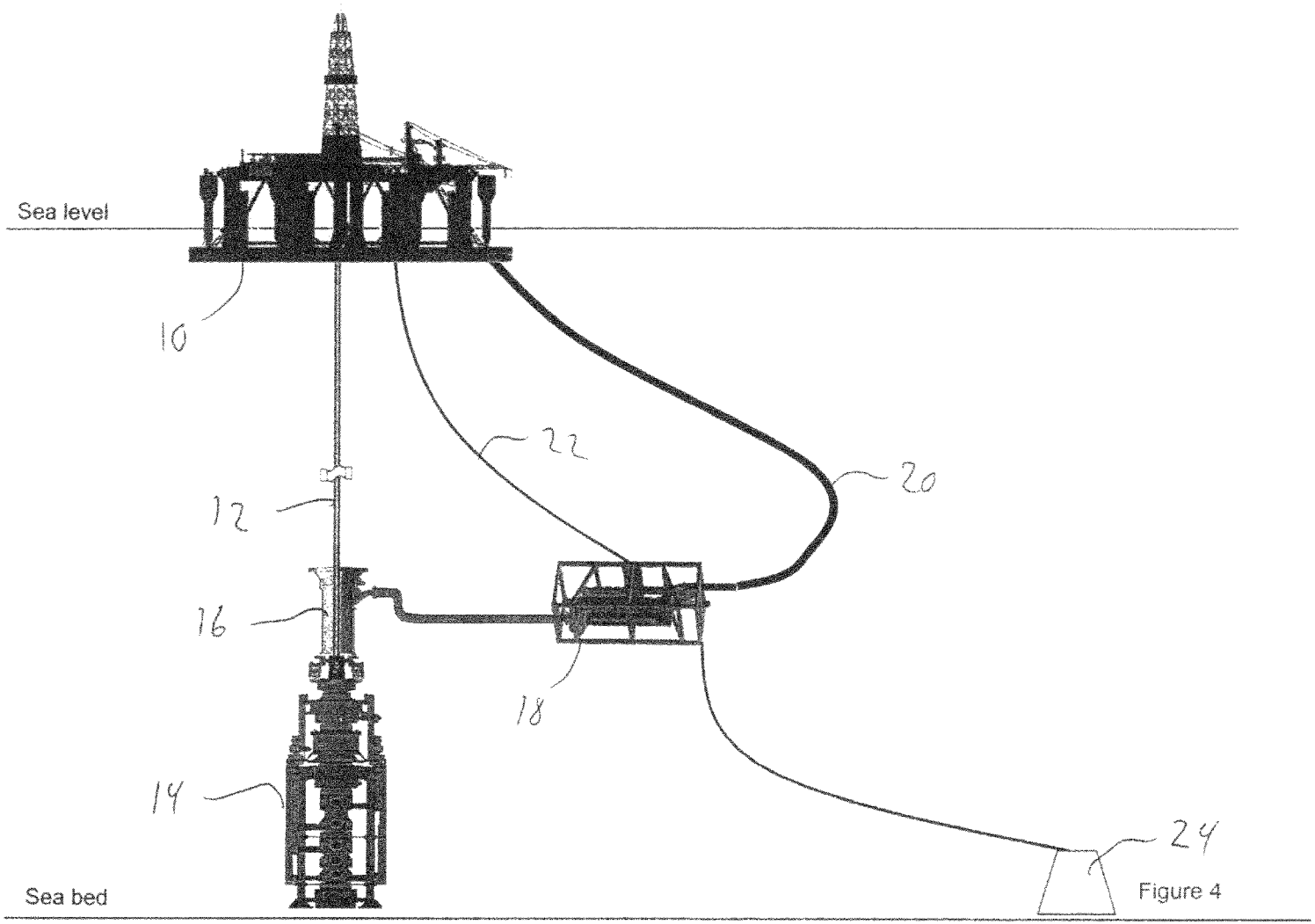
Figure 5:
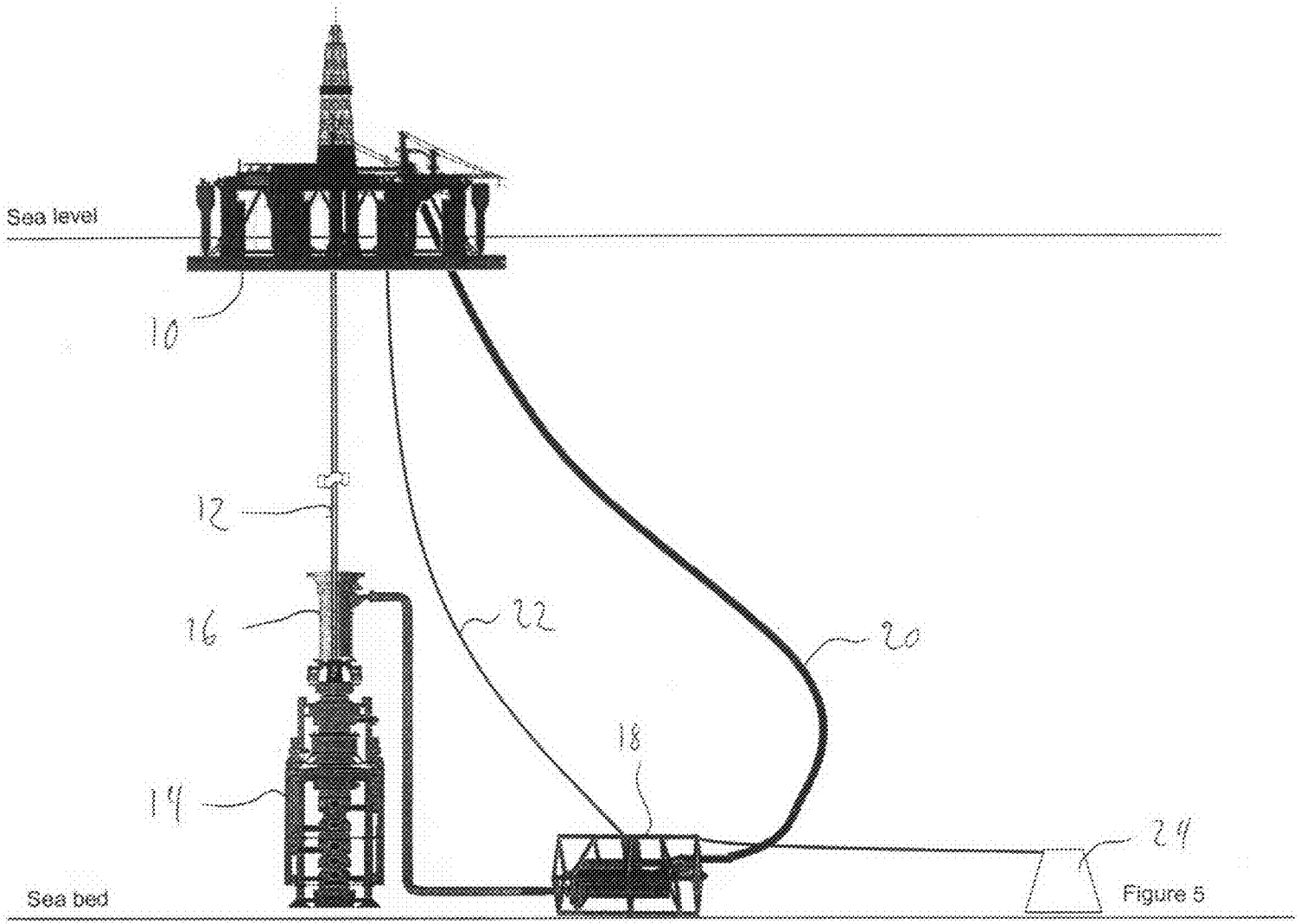

The invention relates to a system which makes it possible to use drilling fluid in the drilling hole without the use of a riser to bring drilling fluid and cuttings to the surface. This can be carried out by using pump units on the ocean floor or hanging from the rig or another vessel. The pump units can also be suspended from a floating device. The floating device can be a buoy or another kind of floating body.

By pumping drilling fluid down the drill stem into the well, the return will come up on the outside of the drill stem, up in the hollow space and when it reaches the BOP (outside the drill stem) and a sealing and pressure-regulating device, for example a SCM, the drilling fluid will be pumped back to the rig for treatment and storage. The drilling fluid is not conducted back to the rig through the riser as usual. The drilling fluid can be conducted back to a vessel and from there back to the drilling vessel, as illustrated herein.

Or the drilling fluid is conducted back to the drilling vessel directly from the pump units while the pump units get energy from the vessel. The pump units can be driven from the drilling vessel. The pump units can also be driven from the vessel. Or they are driven automatically from SCM with the help of sensors so that the level in the SCM is held approximately constant.

The drilling fluid is conducted back to the drilling vessel directly from the pump or pumps. The pump units can also be suspended from a floating element/buoy. The floating element can be partially submerged, and have positive buoyancy, and the pump units can be anchored to the bottom, so that the system is held under tension.

The pump units can also be suspended from the drilling vessel and be anchored to the ocean floor so that the pump units do not come into conflict with the BOP, the SCM or other equipment.

The pump units can also be placed on the ocean floor and be anchored to the ocean floor so that the pump units do not come into conflict with the BOP, the SCM or other equipment. The positioning of the pump unit(s) will, to a large extent, depend on whether there is a need for more pumps connected in series or parallel, ocean depth and the system.

There can be a full two-way communication, data satellite, between drilling vessel and drilling rig, according to what is needed for the system. There can also be control lines to pump units, data, etc, which run physically from vessel to vessel. The drilling fluid can also be conducted back to the drilling vessel from the vessel, or vice-versa, depending on what suits the system.

As sealing and pressure-regulating device, solutions can, for example, be used which are described in the applicant's own Norwegian Patents NO 308.043 and NO 312.915. Said documents are consequently incorporated as references.

In a drilling hole that is drilled into the ocean floor, a sealing device can be arranged, which normally is described as a suction and centralizing module (SCM). This sealing device is normally arranged on the drill head of the drilling hole to seal between the foundation at the wellhead and a well string up to the drilling rig, among other things, and to create an under-pressure in the drilling hole to suck out drilling fluid. Said NO 308.043 discloses a system for removal of drilling fluid from the outlet of a drilling hole, comprising a suction and centralizing module, which can be used as a sealing and pressure-regulating device in the present invention, and is characterized in that an end piece which forms a seal, mainly a liquid-tight seal between the casing and the drill stem, is arranged between the inner surface of the casing and the outer surface of the drill stem, and that at least one exit passage which is connected directly to a pipe system is arranged in the casing, whereupon a pump unit can, for example, be arranged A suction module known from the applicant's Norwegian Patent Application 2003 5172 can also be used as a sealing and pressure-regulating device, which comprises an elongated pipe-formed body, open at the top, and which is arranged to a pipe penetrating the ocean bed, through which a drill stem is fed for drilling of the top hole, and where the pipe-formed body comprises at least one exit passage in the pipe wall for export of return drilling fluid from the drilling hole to a pump module. Furthermore, the pipe-formed body comprises a filter device with through openings, where said openings are arranged to let through, to at least one exit passage, return drilling fluid containing deposits, such as swelling clay and stones, with a size that is less than the diameter of the inlet pipe of the pump or the openings of the pump.

Thus, the invention relates to a method for use and return of drilling fluid/cuttings from a well, which is drilled on the ocean floor, in connection with offshore related oil production and gas production, where a drill stem 12 runs from a drilling rig or drilling vessel 10 down into the drilling hole and where a blowout preventer (BOP) is arranged on said well. According to the invention, the following steps are carried out without a riser being arranged between the rig or vessel and said blowout preventer: to pump drilling fluid down the drill stem 12 in the well, whereby drilling fluid is returned on the outside of the drill stem in an annular space in the drilling hole and up to said blowout preventer 14; to lead the drilling fluid from the blowout preventer 14 to and through a sealing and pressure-regulating device 16 arranged on said blowout preventer and further to a pump module 18 arranged adjacent the well; to regulate the level of the drilling fluid and thus outlet pressure of the drilling fluid; in said sealing and pressure-regulating device 16; and to pump said drilling fluid up to the ocean surface with the help of the pump module 18; via an external return line 20.

The drilling fluid can be conducted through an outlet passage in said sealing and pressure-regulating device 16 to the pump module 18, and the outlet pressure in said outlet passage can be regulated based on the specific gravity of the drilling fluid and the pressure effect of the surrounding seawater on the level of the drilling fluid in said sealing and pressure-regulating device. The level of the drilling fluid in said sealing and pressure-regulating device can be regulated by running the pump module.

The pump module can be suspended from an external surface vessel with the help of a suspension system 22 and be placed at a suitable distance adjacent to said sealing and pressure-regulating device.

Or the pump module can be suspended from a floating element 28 in the water and be placed a suitable distance adjacent to said sealing and pressure-regulating device. The floating element can be partially submerged in the water, with positive buoyancy and the pump module can be anchored to the bottom with the help of an anchorage 24.

Or the pump module can be placed on the ocean floor at a suitable distance from said sealing and pressure-regulating device.

The drilling fluid is preferably pumped to the external vessel 26 with the help of said pump module before it is transported further to the drilling rig or drilling vessel, where the pump module 18 is supplied energy from said external vessel.

Or the drilling fluid can be pumped directly to the drilling rig or drilling vessel 10 with the help of the pump module, at the same time as the pump module 18 gets energy from the external vessel 26.

The pump module 18 can also be suspended from the drilling rig or the drilling vessel 10.

The pump module 18 can be driven and be controlled from the external surface vessel 26, or the pump module can be driven and be controlled from the drilling rig or the drilling vessel 10. The pump module can also be driven automatically with the help of sensors (not shown) in said sealing and pressure-regulating device 16, so that the level of the drilling fluid in said sealing and pressure-regulating device is held approximately constant.

The invention also relates to a system for return of drilling fluid/cuttings from a well, which is drilled on the ocean floor in connection with offshore related oil production and gas production, where a drill stem 12 runs from a drilling rig or drilling vessel 10 down in the drilling hole and where a blowout preventer (BOP) is arranged on said well, without a riser being arranged between the rig or the vessel and said blowout preventer. A sealing and pressure-regulating device 16 is arranged to the blowout preventer 14, set up to regulate the level of the drilling fluid and thus the outlet pressure of the drilling fluid in said sealing and pressure-regulating device 16, and a pump module 18 is arranged at a suitable distance adjacent said sealing and pressure-regulating device, where the pump module is arranged to pump said drilling fluid up to the sea surface, via an external return pipe.

It shall also be pointed out that in an alternative embodiment the pump module and said sealing and pressure-regulating device can be formed as one unit, i.e. the pump module and, for example, said SCM can be one unit, or the pump module and said suction module can be one unit.

Figure 6:
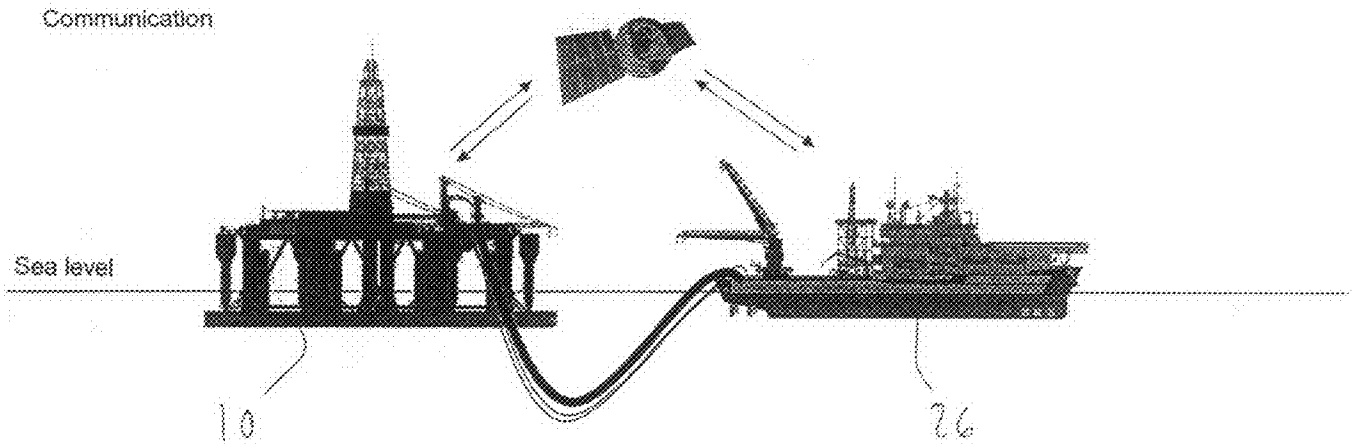

FIG. 6 shows an example of communication between drilling rig or drilling vessel 10 and the external surface vessel 26.

Figure 7:
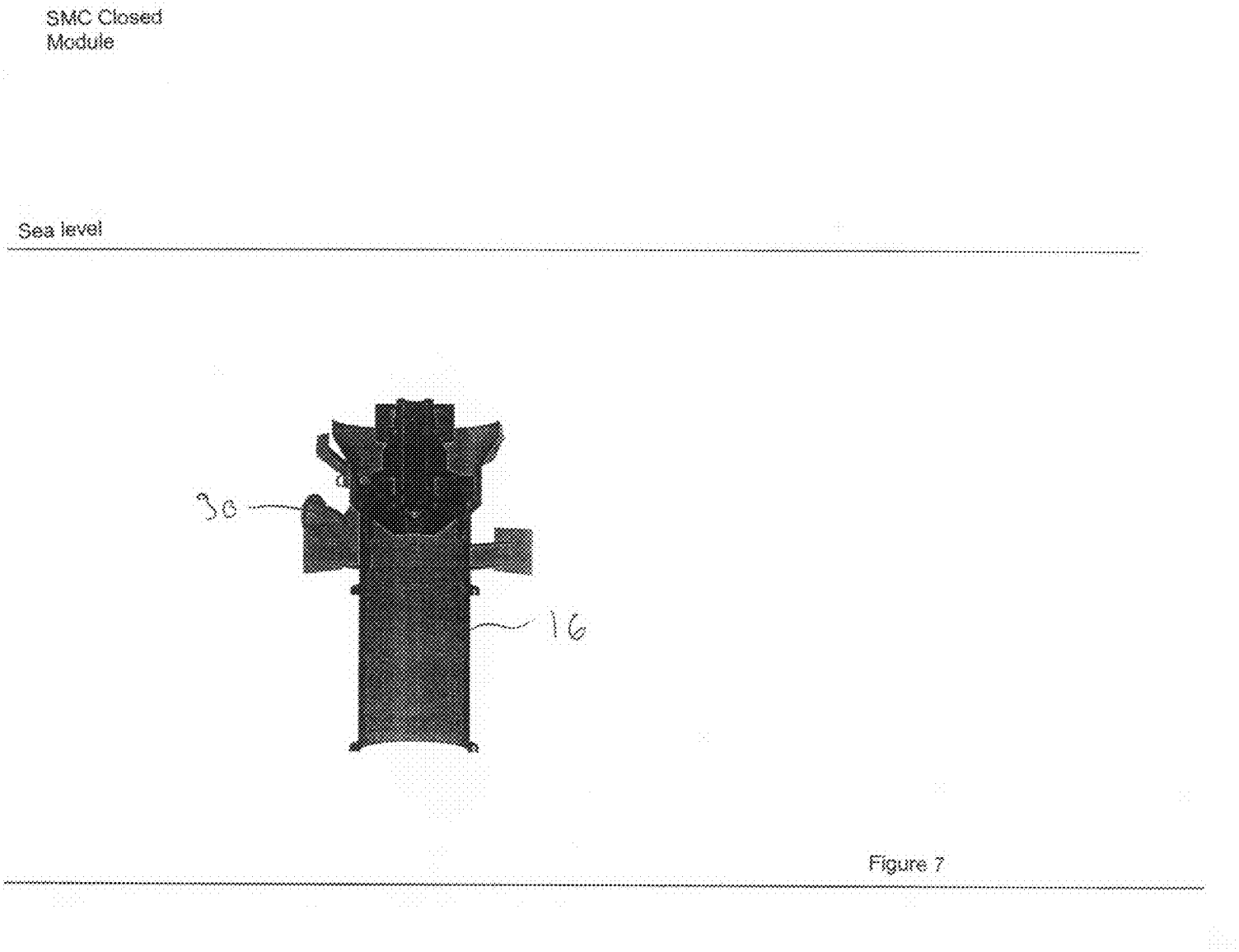
FIGS. 7 and 8 show alternative embodiments of a sealing and pressure-regulating device according to the invention.
Figure 8:
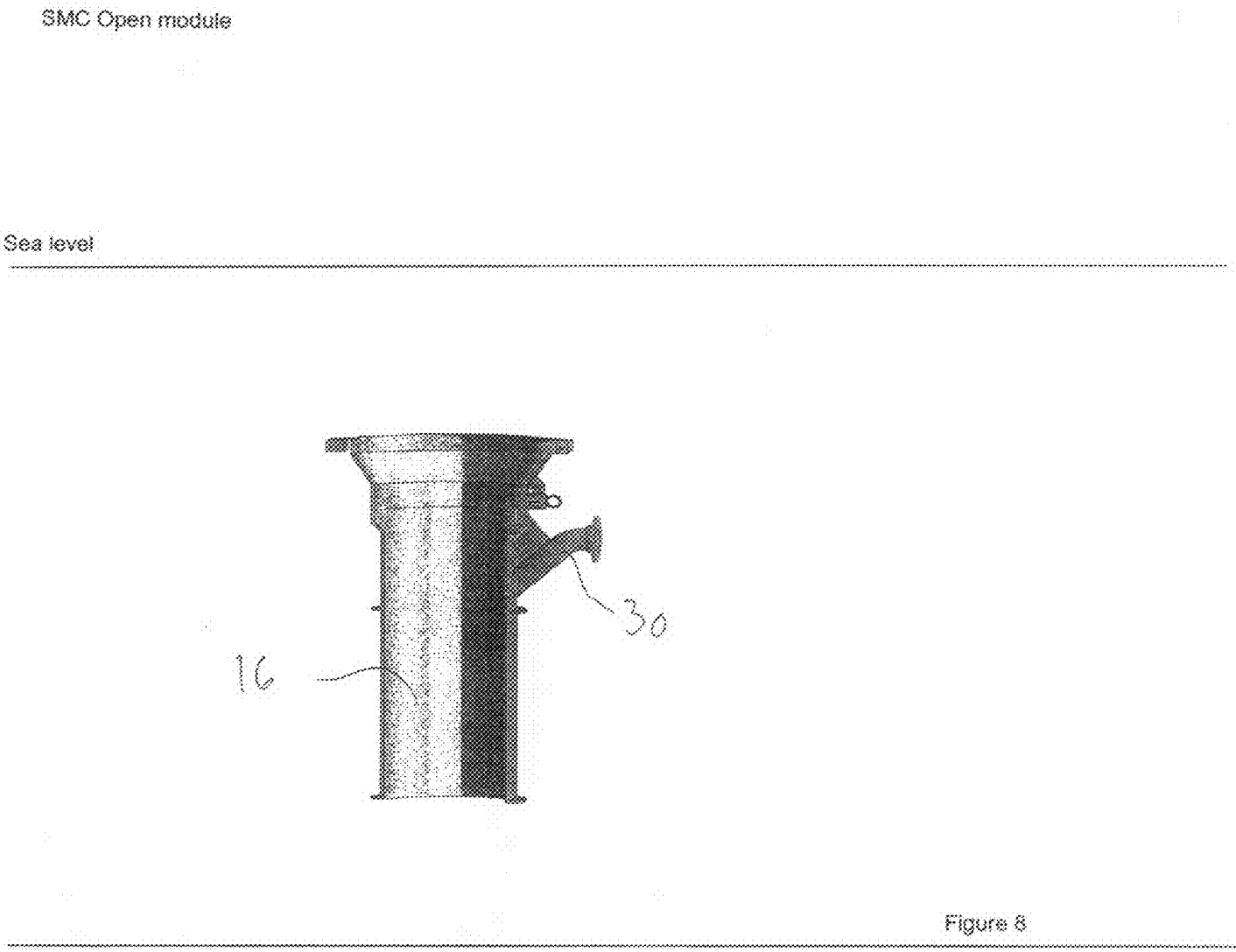

FIGS. 7 and 8 shows an embodiment of a sealing and pressure-regulating device 16. As can be seen in the figures, the device can be closed or open at the top and can comprise at least one outlet passage 30 for drilling fluid/cuttings.

The invention claimed is:

1. Method for use and return of drilling fluid/cuttings from a well, which is drilled on the ocean floor in connection with the offshore related oil production and gas production, where a drilling stem (12) runs from a drilling rig or drilling vessel (10) down into a drilling hole and where a blowout preventer (BOP) (14) is arranged on said well, comprising the following steps, without a riser being arranged between the rig or vessel and said blowout preventer (14):

a) pumping drilling fluid down the drill stem (12) in the well, whereby drilling fluid is returned on the outside of the drill stem in an annular space in the drilling hole and up to said blowout preventer (14) for discharge therefrom at a predetermined outlet pressure; and b) leading the drilling fluid from the blowout preventer (14) to and through a sealing and pressure-regulating device (16) arranged on said blowout preventer and further to pump module (18) arranged adjacent to the well, said sealing and pressure-regulating device (16) having an outlet passage and means to regulate the level of the drilling fluid and the outlet pressure thereof, wherein regulating the level of the drilling fluid, and the outlet pressure of the drilling fluid, in said sealing and pressure-regulating device 16, is accomplished by conducting the drilling fluid through said outlet passage in said sealing and pressure-regulating device (16) to said pump module (18), and that the outlet pressure in said outlet passage is regulated on the basis of specific gravity of the drilling fluid and pressure effects from the surrounding seawater on the level of the drilling fluid, and pumping the drilling fluid up to the sea surface with the help of said pump module via an external return pipe (20).

2. Method according to claim 1, wherein the level of the drilling fluid in said sealing and pressure-regulating device (16) is regulated by driving said pump module (18).

3. Method according to claim 2, wherein said pump module (18) is suspended from an external surface vessel (26) and is placed a suitable distance adjacent to said sealing and pressure-regulating device (16).

4. Method according to claim 2, wherein said pump module (18) is suspended from a floating element (28) in the water and is placed at a suitable distance adjacent to said sealing and pressure-regulating device (16).

5. Method according to claim 4, wherein said floating element (28) is partially submerged in the water, with positive buoyancy, and that said pump module (18) is anchored to the bottom.

6. Method, according to claim 2, wherein said pump module (18) is placed on the ocean floor and at a suitable distance from said sealing and pressure-regulating device (16).

7. Method according to claim 6, wherein the drilling fluid is pumped to an external vessel (26) with the help of said pump module (18) before it is transported further to the drilling rig or drilling vessel (10) and that said pump module (18) is supplied energy from said external vessel (26).

8. Method according to claim 6, wherein the drilling fluid is pumped directly to the drilling rig or drilling vessel (10) with the help of said pump module (18) with said pump module receiving energy from an external vessel (26) at the same time.

9. Method according to claim 2, wherein said pump module (18) is suspended from the drilling rig or drilling vessel (10).

10. Method according to claim 1, wherein said pump module (18) is driven and is controlled from an external surface vessel (26).

11. Method according to claim 1, wherein said pump module (18) is driven and is controlled from the drilling rig or the drilling vessel (10).

12. Method according to claim 10, wherein said pump module (18) is driven automatically with the help of sensors in said sealing and pressure-regulating device (16) so that the level of drilling fluid in said sealing and pressure-regulating device (16) is held approximately constant.

13. System for use and return of drilling fluid/cuttings from a well that is drilled on the ocean floor in connection with offshore related oil production and gas production, where a drill stem (12) runs from a drilling rig or drilling vessel (10) down into the well hole and where a blowout preventer (14) (BOP) is arranged on said well, without a riser being arranged between the rig or the vessel (10) and said blowout preventer (14), where a sealing and pressure-regulating device (16) is arranged to said blowout preventer (14) and a pump module (18) is arranged at a suitable distance adjacent said sealing and pressure-regulating device (16), said pressure regulating device (16) having an outlet passage and means to regulate the level of the drilling fluid and the outlet pressure thereof, wherein the level of the drilling fluid, and the outlet pressure of the drilling fluid, is regulated in said sealing and pressure-regulating device (16) from said outlet passage of said pressure regulating device (16), from which the drilling fluid is conducted to said pump module (18), and that the outlet pressure in said outlet passage is regulated on the basis of specific gravity of the drilling fluid and the pressure influence of the surrounding seawater on the level of the drilling fluid, said pump module being arranged to pump said drilling fluid up to the ocean surface via an external return pipe (20).

14. System according to claim 13, wherein said pump module (18) is arranged to regulate the level of the drilling fluid in said sealing and pressure-regulating device (16) by driving said pump module (18).

15. Method according to claim 1, wherein said pump module (18) is suspended from an external surface vessel (26) and is placed a suitable distance adjacent to said sealing and pressure-regulating device (16).

16. Method according to claim 1, wherein said pump module (18) is suspended from a floating element (28) in the water and is placed at a suitable distance adjacent to said sealing and pressure-regulating device (16).

17. Method according to claim 16, wherein said floating element (28) is partially submerged in the water, with positive buoyancy, and that said pump module (18) is anchored to the bottom.

18. Method according to claim 1, wherein said pump module (18) is placed on the ocean floor and at a suitable distance from said sealing and pressure-regulating device (16).

19. Method according to claim 3, wherein the drilling fluid is pumped to the external vessel (26) with the help of said pump module (18) before it is transported further to the drilling rig or drilling vessel (10) and that said pump module (18) is supplied energy from said external vessel (26).

20. Method according to claim 4, wherein the drilling fluid is pumped to an external vessel (26) with the help of said pump module (18) before it is transported further to the drilling rig or drilling vessel (10) and that said pump module (18) is supplied energy from the external vessel (26).

21. Method according to claim 4, wherein the drilling fluid is pumped directly to the drilling rig or drilling vessel (10) with the help of said pump module (18) with said pump module receiving energy from an external vessel (26) at the same time.

22. Method according to claim 1, wherein said pump module (18) is suspended from the drilling rig or drilling vessel (10).

23. Method according to claim 2, wherein said pump module (18) is driven and is controlled from an external surface vessel (26).

24. Method according to claim 9, wherein said pump module (18) is driven and is controlled from an external surface vessel (26).

25. Method according to claim 2, wherein said pump module (18) is driven and is controlled from the drilling rig or the drilling vessel (10).

26. Method according to claim 10, wherein said pump module (18) is driven and is controlled from the drilling rig or the drilling vessel (10).

27. Method according to claim 11, wherein said pump module (18) is driven automatically with the help of sensors in said sealing and pressure-regulating device (16) so that the level of drilling fluid in said sealing and pressure-regulating device (16) is held approximately constant.

28. Method for use and return of drilling fluid/cuttings from a well, which is drilled on the ocean floor in connection with the offshore related oil production and gas production, where a drilling stem (12) runs from a drilling rig or drilling vessel (10) down into a drilling hole and where a blowout preventer (BOP) (14) is arranged on said well, comprising the following steps, without a riser being arranged between the rig or vessel (10) and said blowout preventer (14):

a) pumping drilling fluid down the drill stem (12) in the well, whereby drilling fluid is returned on the outside of the drill stem (12) in an annular space in the drilling hole and up to said blowout preventer (14) for discharge therefrom at a predetermined outlet pressure, and b) leading the drilling fluid from the blowout preventer (14) to and through a sealing and pressure-regulating device (16) arranged on said blowout preventer (14) and further to said pump module (18) arranged adjacent to the well, said sealing and pressure-regulating device (16) having means to regulate the level of the drilling fluid and the outlet pressure thereof, wherein regulating the level of the drilling fluid and the outlet pressure of the drilling fluid, in said sealing and pressure-regulating device 16, is accomplished by driving said pump module and conducting the drilling fluid through an outlet passage in said sealing and pressure-regulating device (16) to said pump module (18), and that the outlet pressure in said outlet passage is regulated on the basis of specific gravity of the drilling fluid and pressure effects from the surrounding seawater on the level of the drilling fluid, said pump model (18) being driven and controlled from the drilling rig or the drilling vessel (10), and pumping the drilling fluid up to the sea surface with the help of said pump module via an external return pipe (20).

* * * * *